US006684958B2

(12) United States Patent
Williams et al.

(10) Patent No.: US 6,684,958 B2
(45) Date of Patent: Feb. 3, 2004

(54) FLAPPER LOCK OPEN APPARATUS

(75) Inventors: Ronald D. Williams, Broken Arrow, OK (US); Grant R. Thompson, Tulsa, OK (US); James T. Sloan, Broken Arrow, OK (US); Brian S. Shaw, Broken Arrow, OK (US); John L. McCoy, Jr., Broken Arrow, OK (US); Barry L. Brown, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/122,539

(22) Filed: Apr. 15, 2002

(65) Prior Publication Data

US 2003/0192703 A1 Oct. 16, 2003

(51) Int. Cl.[7] ..... E21B 34/10

(52) U.S. Cl. ..... 166/386; 166/382; 166/321; 166/323; 166/332.8

(58) Field of Search ..... 166/382, 386, 166/321, 323, 332.8, 373

(56) References Cited

U.S. PATENT DOCUMENTS

| | | | | |
|---|---|---|---|---|
| 3,786,866 A | | 1/1974 | Tausch et al. | |
| 4,213,508 A | | 7/1980 | Tschirky et al. | |
| 4,344,602 A | | 8/1982 | Arendt | |
| 4,457,379 A | | 7/1984 | McStravick | |
| 4,566,541 A | | 1/1986 | Moussy et al. | |
| 4,574,889 A | | 3/1986 | Pringle | |
| 4,577,694 A | | 3/1986 | Brakhage, Jr. | |
| 4,624,315 A | * | 11/1986 | Dickson et al. | 166/323 |
| 4,729,432 A | | 3/1988 | Helms | |
| 4,760,879 A | | 8/1988 | Pringle | |
| 4,846,281 A | | 7/1989 | Clary et al. | |
| 4,967,845 A | * | 11/1990 | Shirk | 166/386 |
| 5,040,283 A | | 8/1991 | Pelgrom | |
| 5,564,675 A | | 10/1996 | Hill, Jr. et al. | |
| 6,059,041 A | * | 5/2000 | Scott | 166/373 |
| 2002/0040788 A1 | * | 4/2002 | Hill, Jr. et al. | 166/382 |
| 2002/0170719 A1 | * | 11/2002 | Deaton | |
| 2003/0075323 A1 | * | 4/2003 | Vercaemer et al. | |

* cited by examiner

*Primary Examiner*—William Neuder
(74) *Attorney, Agent, or Firm*—Duane Morris LLP

(57) ABSTRACT

Various techniques for holding open an SSSV using expansion technology are disclosed. A sleeve is delivered to the SSSV and expanded mechanically or hydraulically to deposit the deformed sleeve in position over a flapper or against a flow tube holding the flapper in the open position.

14 Claims, 6 Drawing Sheets

FLAPPER LOCK OPEN APPARATUS

FIELD OF THE INVENTION

The field of this invention is mechanisms that can hold open a subsurface safety valve (SSSV) that has malfunctioned so that another valve can be installed to take its place.

BACKGROUND OF THE INVENTION

SSSVs are normally closed valves that are used primarily in offshore and gas wells to prevent uncontrollable flow of fluid to the surface, in the event the surface safety equipment fails to properly operate. If the SSSV malfunctions or for any other reason requires replacement with a backup SSSV, the well operator will normally want the old SSSV locked in the open position so it does not interfere with well operations after the old SSV has been taken out of service. Typically, to avoid undue complication in the design and operation of an SSSV, the lock open assembly is not installed with the SSSV but is subsequently run in when needed on an accessory tool known as a flapper lock open (FLO) tool.

One known design of an FLO tool is U.S. Pat. No. 4,577,694, which illustrates the use of a scroll of wound spring steel that is allowed to spring out after being delivered to the SSSV to keep the flapper from rotating back to a closed position. The downside of this design and several others is that flow through the locked open SSSV could and did, at times, dislodge the lock open device, allowing the flapper to close off the well. In this particular patent, the ring of steel was coiled, like a watch spring and held at opposite ends until properly positioned. When the delivery tool released the ring, it sprang outwardly to contact the flapper. This tool was complicated and required stocking of various sizes of rings as well as an installation method that involved two wireline trips with jar down/jar up activation.

Another technique, shown in U.S. Pat. No. 5,574,889 required that the flow tube be engaged and forcibly moved down to get the flapper into the open position. After that one or more indentations were made in the flow tube, which could engage a shoulder and prevent the flow tube from returning to the flapper-closed position. This device had several disadvantages. The flow tube was permanently damaged. The tool required enough force to overcome bias on the flow tube to push it into the flapper open position. Finally, part of the procedure required pumping fluid under pressure into the well, which could adversely affect subsequent production.

Another technique, shown in U.S. Pat. No. 5,564,675, the flow tube is forcibly engaged and pushed so far down that the actuating piston comes out of its seal bore in a manner as to wedge the flow tube in the flapper open position. This design has similar disadvantages as U.S. Pat. No. 5,574,889 and a further disadvantage that flow communication to the control system occurs due to operation of this lock open device.

Another technique illustrated in U.S. Pat. No. 6,059,041, forces the flow tube down and releases an expandable tube to hold the flapper open. Similar, disadvantages as the previous two techniques are realized in this design.

Other art in the area of lock open devices for SSSVs includes U.S. Pat. Nos. 3,786,866; 4,344,602; 4,967,845; 4,624,315 and 4,457,379. Of more general interest are U.S. Pat. Nos. 5,040,283(using a shape memory metal for downhole patches); 4,846,281; 4,760,879; 4,729,432; 4,566,541 and 4,213,508.

One of the objectives of the present invention is to deliver and set a hold open device in an SSSV in a manner that it will not become dislodged. The technique to accomplish this objective comprises using an expansion of a tubular member so as to deform it into position where it will prevent a flow tube from returning to the flapper closed position or to actually use the expanded structure directly against the flapper when it is held open by the flow tube. Those skilled in the art will have a clearer understanding of the various embodiments for accomplishing the objective of holding an SSSV in an open position from the detailed description of the preferred embodiment and the claims, which appear below.

SUMMARY OF THE INVENTION

Various techniques for holding open an SSSV using expansion technology are disclosed. A sleeve is delivered to the SSSV and expanded mechanically or hydraulically to deposit the deformed sleeve in position over a flapper or against a flow tube holding the flapper in the open position.

DETAILED DESCRIPTION OF THE DRAWINGS

DETAILED DESCRIPTION OF THE PREFERRED EMBODIMENT

Figure 13:
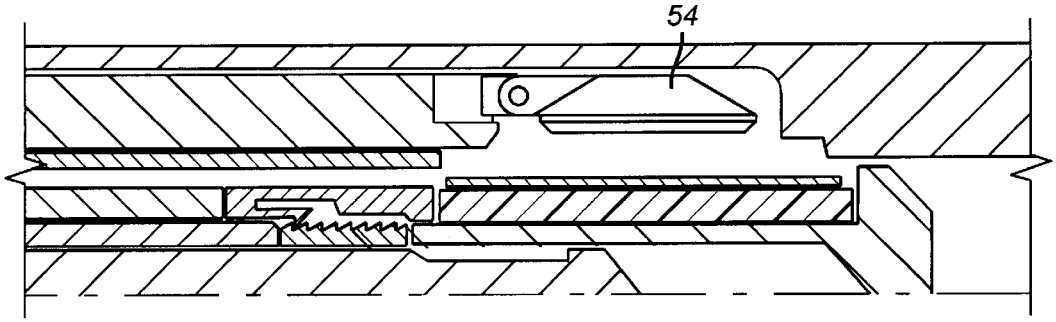
FIGS. 13–16 show an expansion sequence of a sleeve against a flapper using a mechanically compressed resilient ring.
Figure 14:
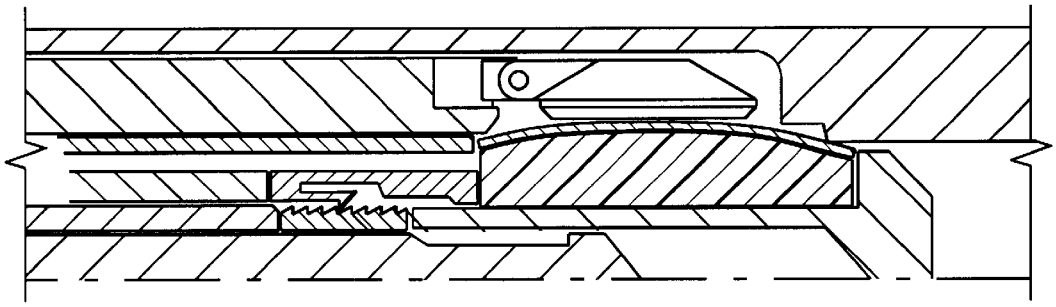
Figure 15:
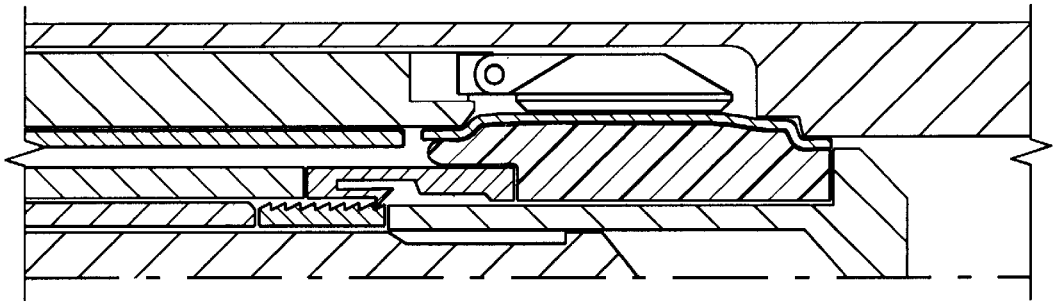
Figure 16:
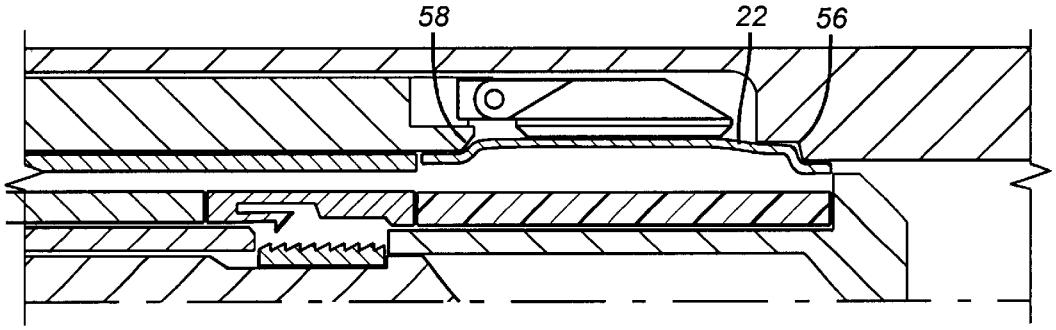

The present invention deals with ways of holding an SSSV in an open position. This can be done by holding open the flapper, as illustrated in FIGS. 13–15 or holding the flow tube when the flow tube pushes the flapper into an open position, as shown in FIGS. 5–8, for example.

Figure 1:
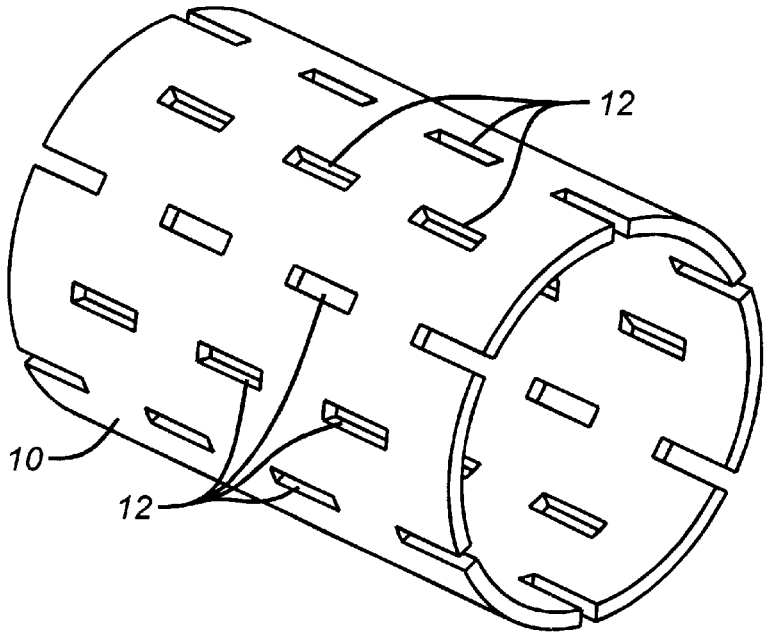
FIG. 1 is a perspective view of a slotted sleeve in the unexpanded position.
Figure 2:
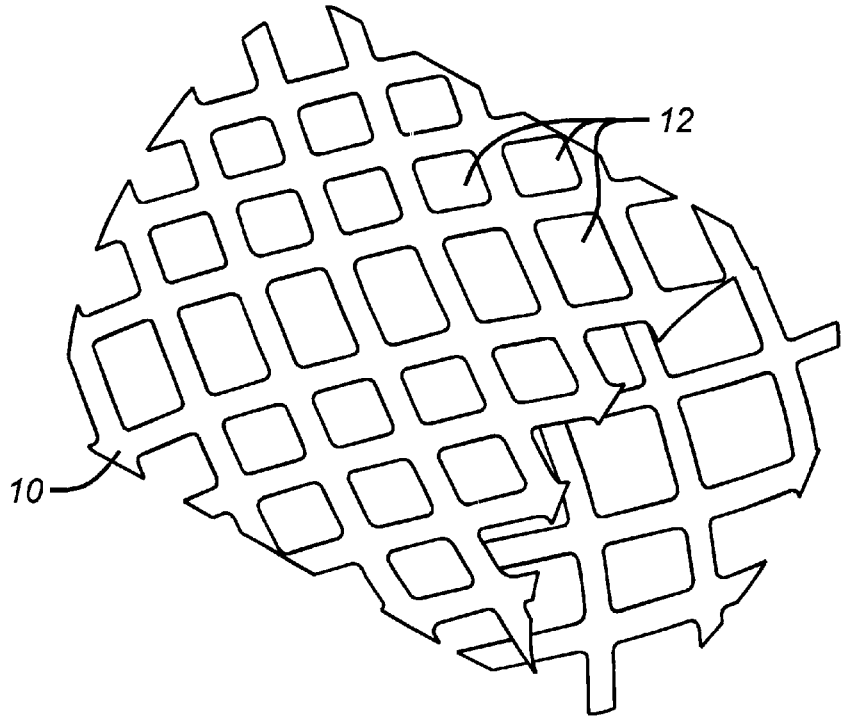
FIG. 2 is the view of FIG. 1 with the sleeve in the expanded position.

The preferred device for holding the SSSV open is a tube 10 that has slots 12 or any other shaped openings on it to facilitate expansion but at the same time to retain sufficient structural integrity after expansion to avoid collapse or simple breakage. Shown in FIG. 1, the slots 12 are rectangular and are in alignment with the longitudinal axis of the tube 10. Other arrangements and orientations are envisioned. As shown in FIG. 2, the slots 12 turn from a rectangular shape to a diamond shape after expansion. The tube 10 is permanently deformed so that it will not spring back to its run in dimension. The deformation results in a residual holding force to keep the tube 10 in place against the velocity of flowing fluid. The expansion can be carried out using a variety of techniques such as a swage, a mechanically compressed resilient sleeve, or an inflatable, to mention a few possibilities.

Figure 3:
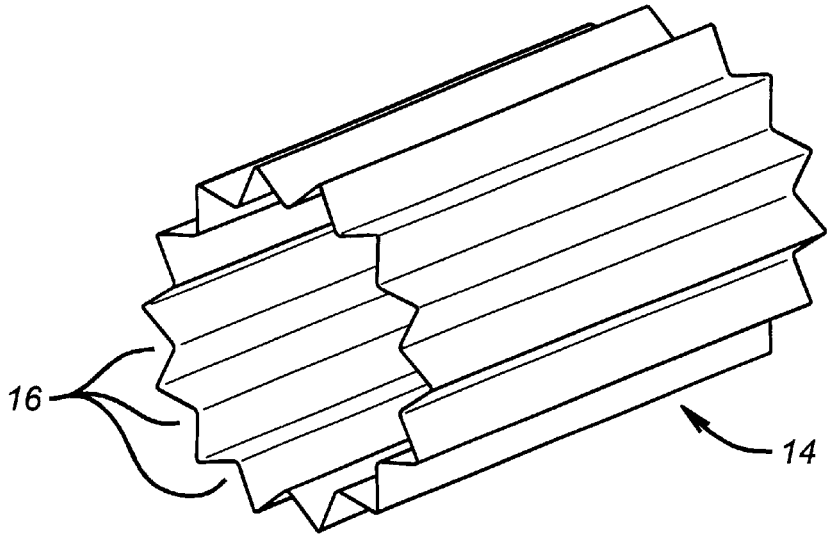
FIG. 3 is an alternative sleeve having longitudinal flutes before expansion.
Figure 4:
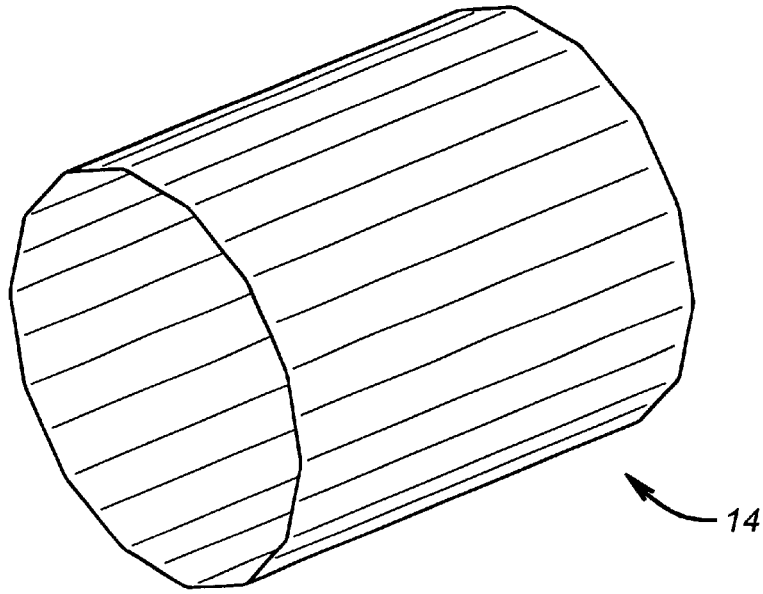
FIG. 4 is the sleeve of FIG. 3 after expansion.
Figure 5:
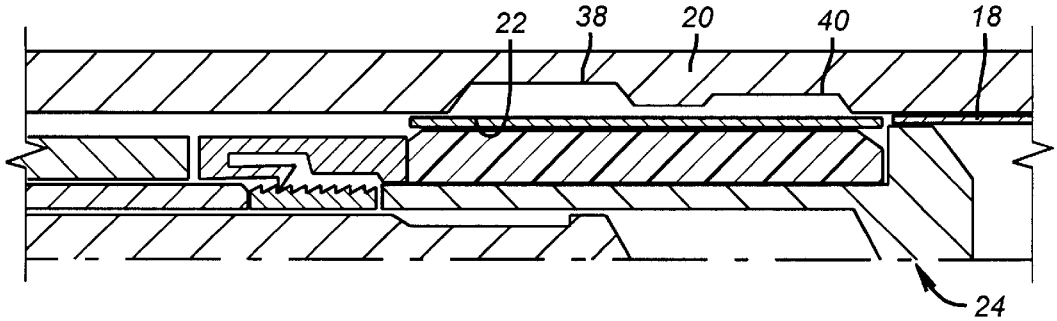
FIGS. 5–8 are an expansion sequence for a sleeve using a mechanically compressed resilient sleeve to accomplish the expansion.
Figure 6:
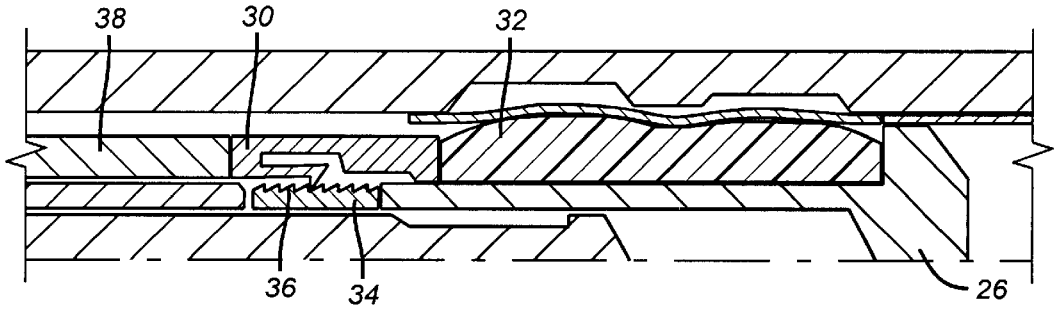

FIG. 3 shows a tube 14 having longitudinal folds or corrugations 16 to give it a small enough diameter to allow it to be positioned properly inside the SSV. In the expanded position it is rounded and preferably deformed into contact with a flapper or the flow tube or both to hold the SSSV in the closed position. Once again, many expansion techniques can be used to fixate tube 14 in the chosen position.

Figure 7:
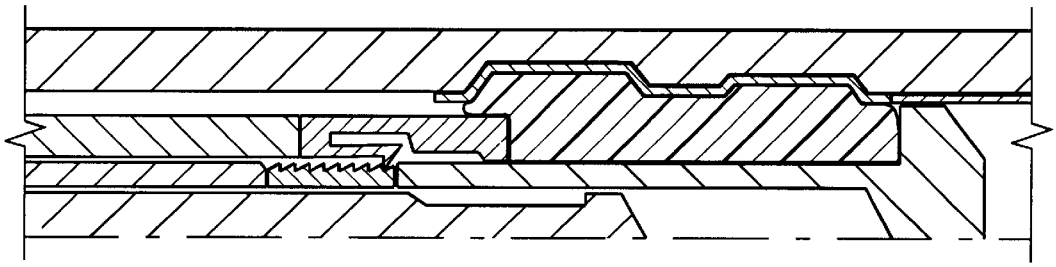
Figure 8:
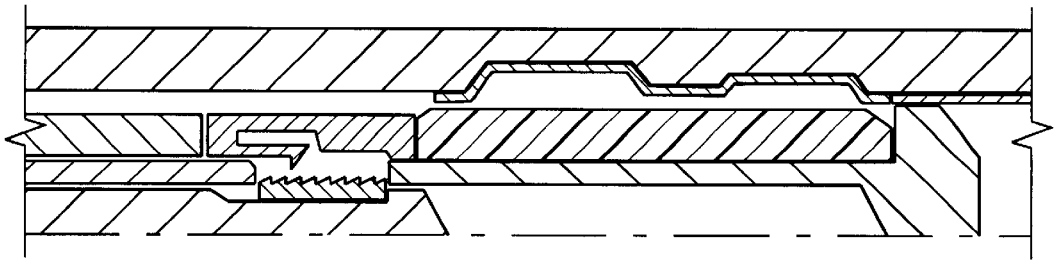
Figure 9:
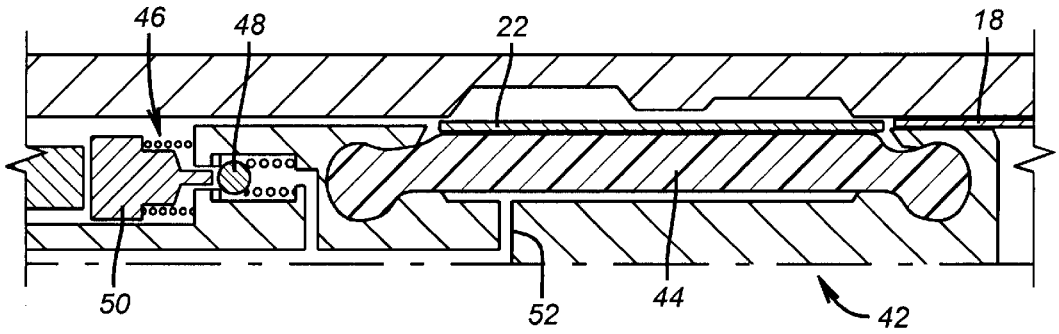
FIGS. 9–12 show an expansion sequence for a sleeve using an inflatable.
Figure 10:
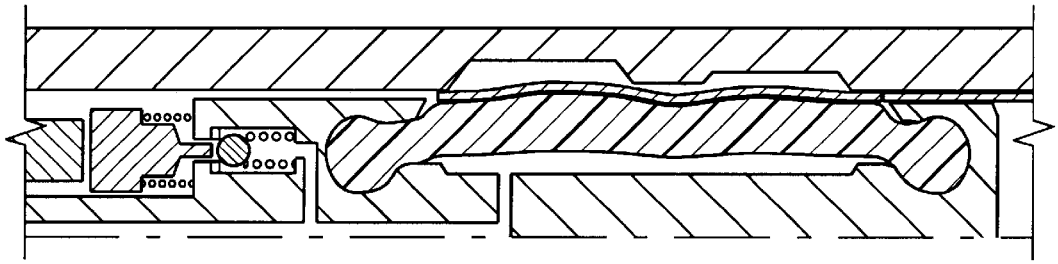
Figure 11:
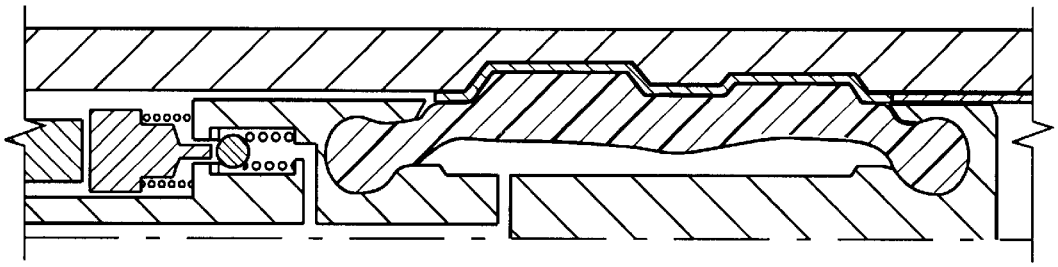
Figure 12:
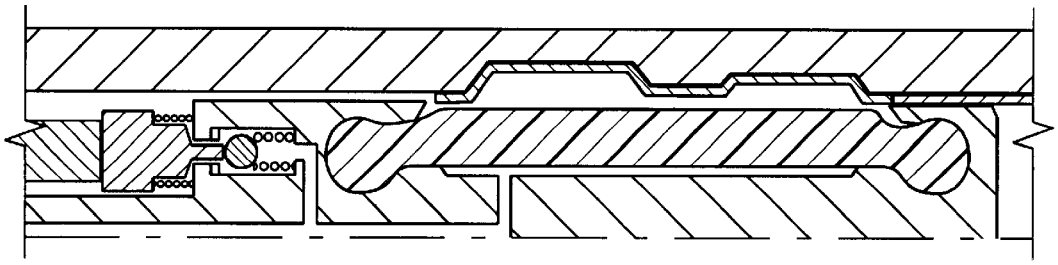

FIGS. 5–8 show the flow tube 18 in SSSV housing 20 in the position where the flapper (not shown) is in the open position. The tube 22 is delivered on an expansion tool 24. It has a body 26 and a shifting sleeve 28 that bears down on ratchet sleeve 30 to compress the resilient ring 32. The set position can be retained with lock ring 34 by virtue of teeth 36. Those skilled in the art will realize that FIGS. 5–8 are schematic. Locking the set position is not essential. The tube 22, however constructed, is to be expanded sufficiently to plastically deform or expanded in such a way as to leave a residual compressive force in the grooves such as 38 and 40 into which it anchors by deforming to take their shape, as shown in FIG. 7. The compressive force applied to the resilient ring 32 has been removed in FIG. 8 so that the tool 24 can be withdrawn after the resilient ring 32 relaxes. Tube 22 can be expanded into a single groove or two grooves or any other surface irregularity internal to the SSSV where the flow tube 18 will be in the flapper open position. The tube 22 can even be expanded into a smooth bore inside the SSSV to trap the flow tube 18, although a surface irregularity is preferred for better anchoring of the tube 22.

FIGS. 9–12 show the use of an inflatable tool 42, which is schematically illustrated. It has an inflatable element 44 and a valve system 46 of a type commonly used in inflatable packers. The valve system 46 comprises a check valve 48 to hold element 44 in the inflated position. A release valve 50 overrides check valve 48 to release the inflation pressure. A passage 52 communicates the inflation pressure to under the element 44. The tube 22 is expanded and preferably anchored to an internal surface irregularity after being plastically deformed. The flow tube 18 is again locked into position with the flapper open.

FIGS. 13–16 are similar to FIGS. 5–8 except for the location where the tube 22 is being expanded. In FIGS. 13–16, the tube 22 is expanded against the flapper 54 itself. The tube 22 straddles the flapper 54 and engages shoulders 56 and 58. Those skilled in the art will appreciate that variation of the length of tube 22 can allow it to be expanded against the edge of the flow tube 18 or straddling the flapper 54 or spanning over one or both of these SSSV components.

Figure 17:
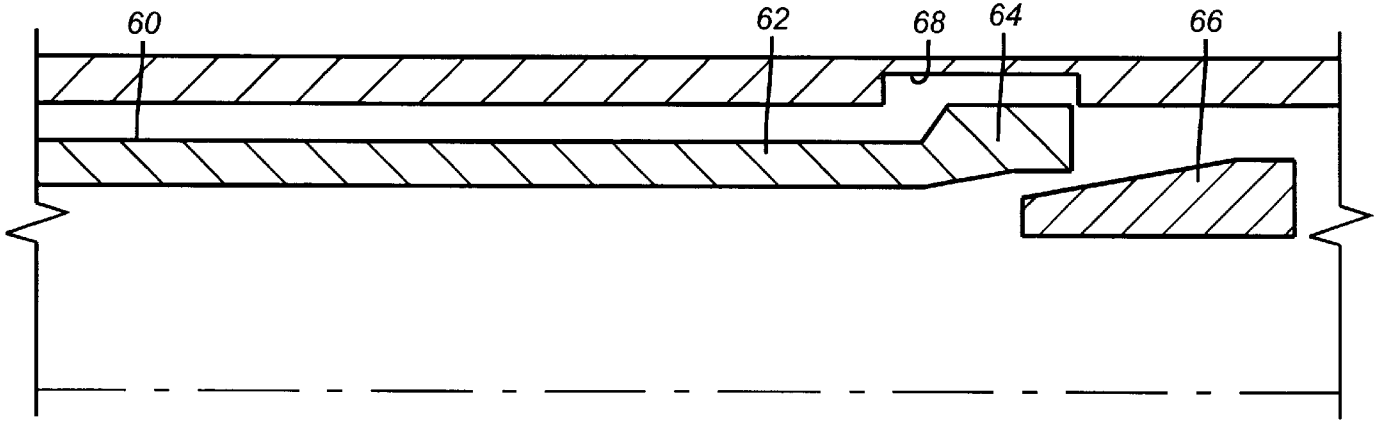
FIGS. 17–18 show the use of a ring with extending collet fingers that is run in and outwardly expanded to hold a flow tube against the flapper in the open position.
Figure 18:
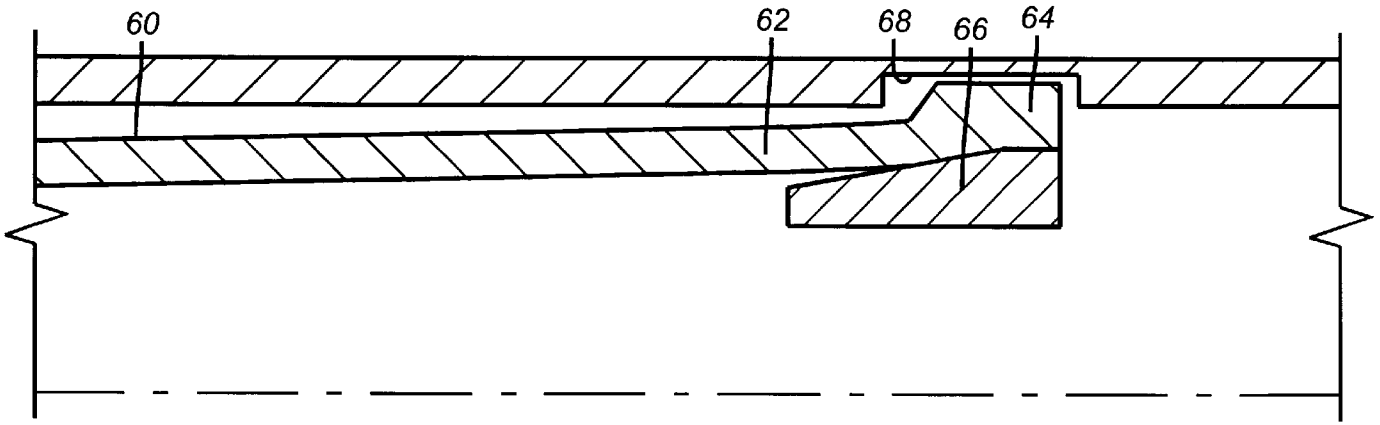

FIGS. 17–18 display another technique. Here a ring 60 has extending fingers 62 that have heads 64 at their ends. A running tool (not shown) delivers a wedge ring 66 that pushes the heads 64 onto a shoulder 68 or some other surface irregularity so that the entire assembly is anchored. Depending on the placement, the assembly can directly retain a flapper 54 or a flow tube 18 with the flapper 54 in the open position or parts of both. In this application the fingers 62 are not necessarily plastically deformed with respect to the ring 60. Rather, the preferred technique is a wedging action to retain the assembly in place to hold the flow tube 18 the flapper 54 or both in the flapper-open position.

Those skilled in the art will appreciate that the use of a sleeve that is expanded to a degree to leave a residual contact force allows for a greater assurance that the sleeve will stay in place after it has been set. The sleeve placement can be such that it retains the flapper directly or indirectly through the flow tube, which actuates it. The sleeve can be perforated with openings of various shapes or a common shape. The openings can be arranged in an orderly pattern or can be randomly distributed. The sleeve can also be solid without any openings and its thickness can be constant along its length or it can be varied. The expansion and run in device can be a swage, a mechanically expanded resilient or other type of sleeve or an inflatable. Known tools can be used to perform the expansion or they can be slightly modified to meet the requirements of the particular application. Such tools can contact the flow tube 18 to put it into the open position, or they can go through the flow tube and push the flapper 54 into the open position before actuation. For example, a mechanically set packer can be used without the slip assembly and even without the locking mechanism that typically holds the set. This is because the sleeve, once expanded, needs not to be held in that position. Once the expansion is accomplished the expansion tool can be promptly removed. Regardless of the expansion technique, any type of sleeve mentioned above or modifications of such sleeve can be used to effectively hold the SSSV in the open position.

We claim:

1. A method for locking open a subsurface safety valve, comprising:

delivering expandable member into the subsurface safety valve;

putting the subsurface safety valve into an open position; and expanding said expandable member with an applied force to secure its placement while holding the subsurface safety valve open;

bending said expandable member over at least one shoulder to improve longitudinal fixation to the subsurface safety valve.

2. The method of claim 1, comprising:

plastically expanding said expandable member.

3. The method of claim 1, comprising:

providing openings in said expandable member.

4. The method of claim 1, comprising:

engaging a flapper with said expandable member.

5. The method of claim 1, comprising:

engaging a flow tube with said expandable member.

6. The method of claim 4, comprising:

engaging a flow tube and said flapper with said expandable member.

7. The method of claim 3, comprising:

providing elongated slots as said openings.

8. The method of claim 1, comprising:

driving a swage into said expandable member to expand it; and removing the swage.

9. The method of claim 1, comprising:

expanding said expandable member with an inflatable tool.

10. The method of claim 1, comprising:

providing longitudinal corrugations in said expandable member to reduce its outer dimension for placement; and expanding said expandable member to remove said corrugations.

11. The method of claim 10, comprising:

expanding said expandable member to a dimension greater than the dimension at which said corrugations are removed by making the cross-sectional shape round.

12. A method for locking open a subsurface safety valve, comprising:

delivering expandable member into the subsurface safety valve;

putting the subsurface safety valve into an open position; and expanding at least a portion of said expandable member with an applied force to secure its placement while holding the subsurface safety valve open;

providing a plurality of collet fingers extending from said expandable member and terminating in a head;

wedging said heads in the subsurface safety valve to secure the open position.

13. The method of claim 12, comprising:

using a ring shaped swage to wedge said heads; and leaving said swage in place after said heads are wedged.

14. A method for locking open a subsurface safety valve, comprising:

delivering expandable member into the subsurface safety valve;

putting the subsurface safety valve into an open position; and expanding at least a portion of said expandable member with an applied force to secure its placement while holding the subsurface safety valve open;

mounting said expandable member on a resilient member in an actuating tool;

applying a compressive force to said resilient member; and forcing the expandable member to expand with said resilient member.

* * * * *